US005871144A

United States Patent [19]

Anchor et al.

[11] Patent Number: 5,871,144

[45] Date of Patent: Feb. 16, 1999

[54] EIGHT SIDED GABLE TOP CARTON

[75] Inventors: David Anchor, Union; Russell Stacey-Ryan, Chicago, both of Ill.

[73] Assignee: Tetra Laval Holdings & Finance SA, Pully, Switzerland

[21] Appl. No.: 902,457

[22] Filed: Jul. 29, 1997

[51] Int. Cl.[6] ..... B65D 5/06

[52] U.S. Cl. ..... 229/109; 229/104; 229/16.1; 229/137

[58] Field of Search ..... 229/104, 109, 229/116.1, 125.42, 213, 214, 249, 137; D9/430, 432

[56] References Cited

U.S. PATENT DOCUMENTS

| | | | |
|---|---|---|---|
| 1,793,101 | 2/1931 | Labombarde . | |
| 2,047,804 | 7/1936 | Shapiro . | |
| 3,253,767 | 5/1966 | Pellaton . | |
| 3,907,194 | 9/1975 | Davenport et al. . | |
| 4,134,531 | 1/1979 | Martinez et al. . | |
| 4,199,098 | 4/1980 | Lopez . | |
| 4,289,267 | 9/1981 | Mayea . | |
| 4,313,556 | 2/1982 | Boyle et al. | 229/116.1 |
| 4,549,690 | 10/1985 | Rosenburg . | |
| 4,630,733 | 12/1986 | Fear | 229/213 |
| 5,029,751 | 7/1991 | Detzel | 229/125.42 |
| 5,257,734 | 11/1993 | Bartle . | |
| 5,474,232 | 12/1995 | Ljungström et al. . | |
| 5,531,375 | 7/1996 | Palm . | |
| 5,628,450 | 5/1997 | Cromwell et al. . | |
| 5,738,272 | 4/1998 | Anchor et al. | 229/109 |

*Primary Examiner*—Gary E. Elkins
*Attorney, Agent, or Firm*—Michael A. Catania

[57] ABSTRACT

The present invention is an eight-sided carton and a blank therefor. The carton has eight side panels, a gable top structure and an inverse pyramidal bottom. The carton may have an octagonal cross-section. A plurality of diagonal score lines provide for a graceful transition from the gable top structure to the side panels, and from the side panels to the inverse pyramidal bottom. The blank has a plurality of vertical score lines which form the edges and the apices of the eight-sided carton.

22 Claims, 6 Drawing Sheets

EIGHT SIDED GABLE TOP CARTON

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to eight-sided containers. Specifically, the present invention relates to eight-sided gable top cartons and carton blanks therefor.

2. Description of the Related Art

Gable top cartons have been known for the better part of the twentieth century. Their characteristic simplicity and resealability have helped to sustain their popularity as containers for traditional liquid food products such as milk and juice, but in recent years they have been used for products ranging from ammunition to Epsom salts. Gable top cartons typically begin as generally rectangular carton blanks made of a laminated paperboard or similar material. The carton blanks are provided with a number of creases to facilitate folding and forming the blank into a rectangular carton having the characteristic gabled top.

When fully folded, filled, and sealed, the gable top cartons included a gabled top structure that engages four side-panels. Traditionally, each side panel is generally perpendicular to each adjacent side panel. The panels are each divided from one another by a single vertical score line extending the entire height of the sidewall. These side panels form the characteristic hollow rectangular body of the container and define the volume of product that a carton may hold.

In accordance with accepted design approaches, the design of a traditional gable top carton to accommodate a specified volume involves adjusting the dimensions of the four sidewalls defining the rectangular body that is to contain the specified volume. Very often, these product volume requirements are specified by the packager and selected from standard volumes that have been deemed accepted in the consumer market for the product (i.e., pint, quart, half gallon, gallon, half liter, liter, etc.). When this design approach is utilized, there exists a generally established relationship between the surface area of the carton blank and the carton volume. The surface area of the carton, and particularly the area of the four sidewalls constituting the bulk of the surface area, is thus generally fixed for a given container volume.

Additional end panel extensions and end panel shapes are often employed to assist in folding and sealing the traditional gable top cartons. These added extensions and shapes result in added carton surface area per unit volume of product.

The traditional approaches to gable top carton design have heretofore devoted little effort to optimizing the carton surface area per unit volume of product.

BRIEF SUMMARY OF THE INVENTION

The present invention is an eight-sided carton having an inverse pyramidal bottom. The carton has eight side panels with each pair of side panels meeting at an apex which is the farthest extent outward of the carton on four general sides. The carton may have an octagonal cross-section. The inverse pyramidal bottom allows for greater stability of the carton in an upright position.

Another aspect of the present invention is a blank for forming the eight-sided carton. The blank has a plurality of vertical score lines and a plurality of diagonal score lines which define the side panels and top and bottom flaps of the carton.

It is a primary object of the present invention to provide an eight-sided carton.

It is a further object of the present invention to provided a multi-sided carton.

It is a further object of the present invention to provide a blank for an eight-sided carton.

It is a further object of the present invention to provide a carton having greater stability than traditional cartons.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of a folded and sealed carton of the present invention.

Figure 1:
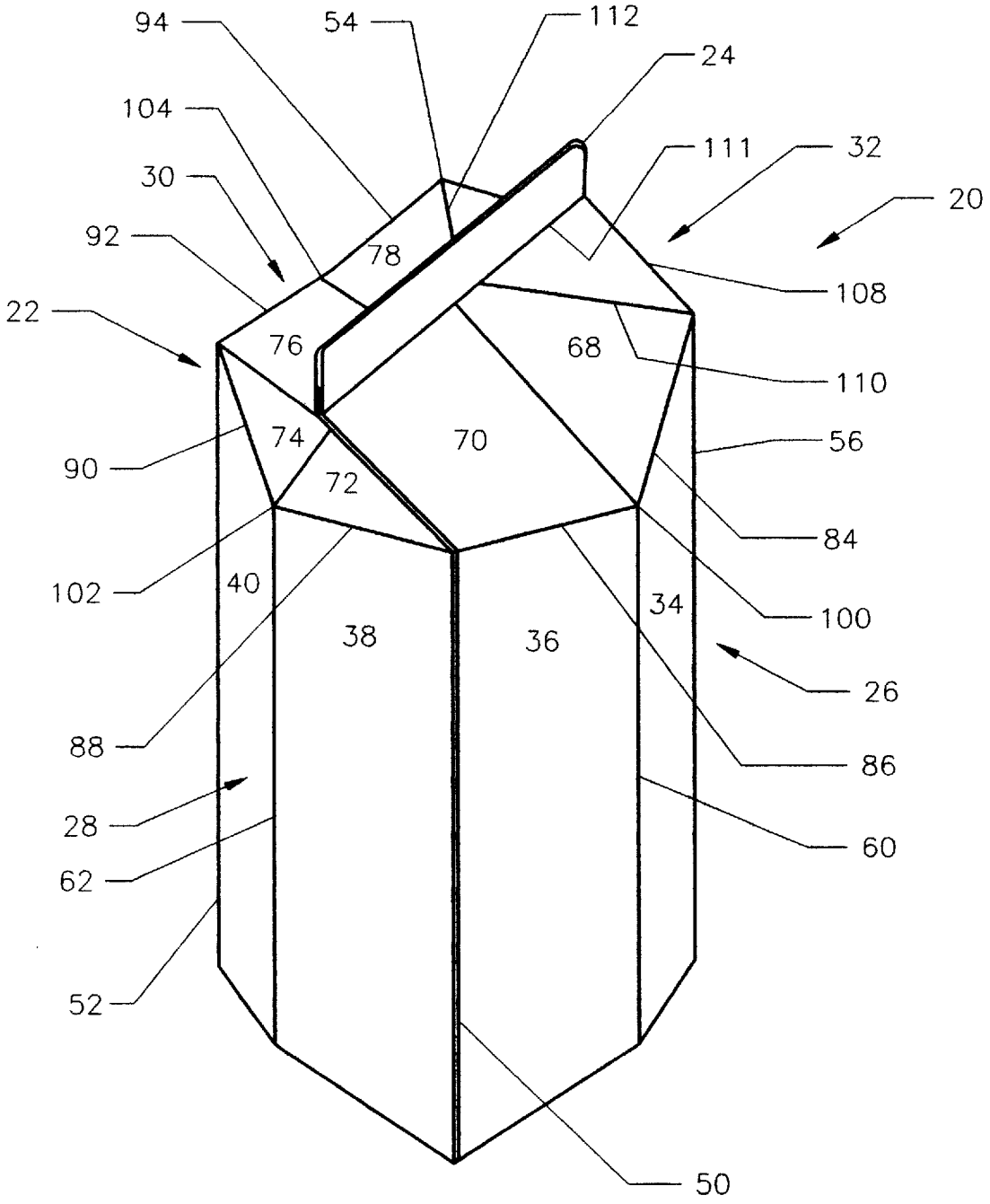
Figure 2:
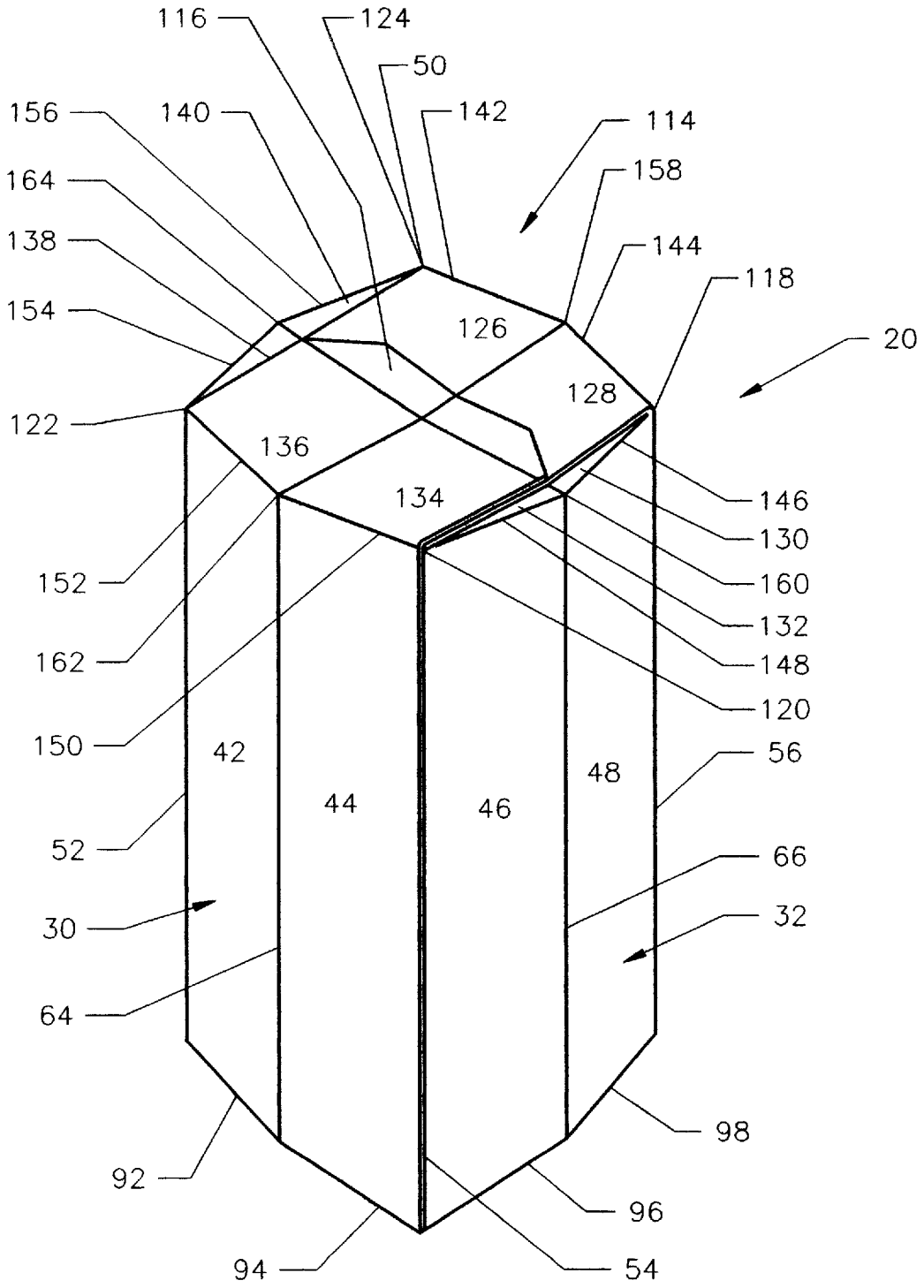

There is illustrated in FIG. 2 a bottom perspective view of the carton of FIG. 1.

Figure 3:
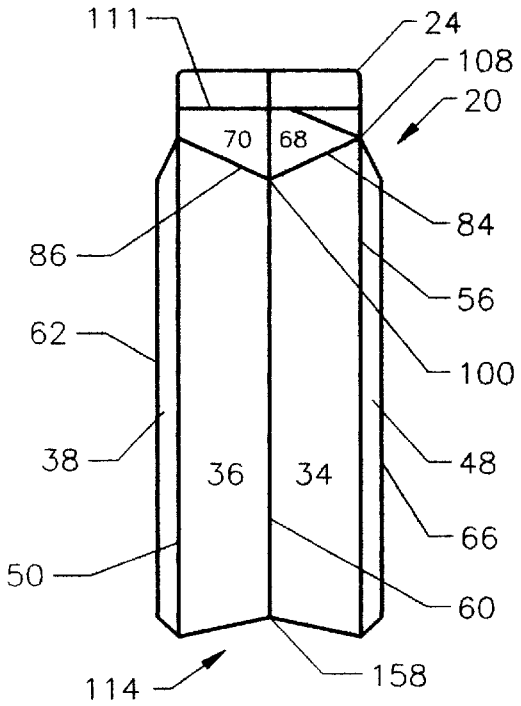

There is illustrated in FIG. 3 a front elevational view of the carton of FIG. 1.

Figure 4:
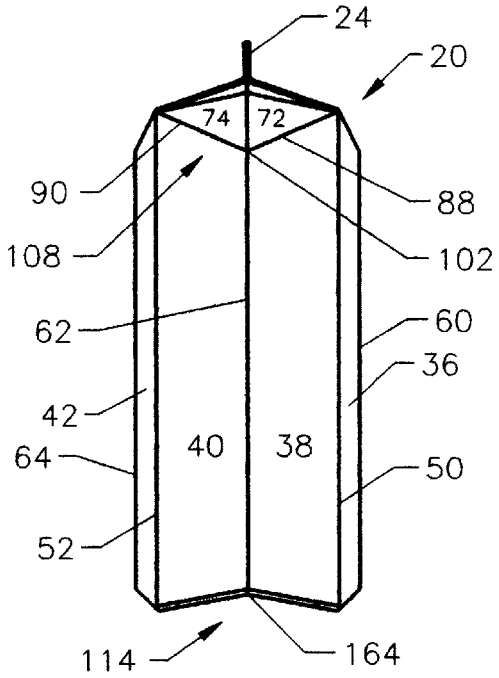

There is illustrated in FIG. 4 a side elevational view of the carton of FIG. 1.

Figure 5:
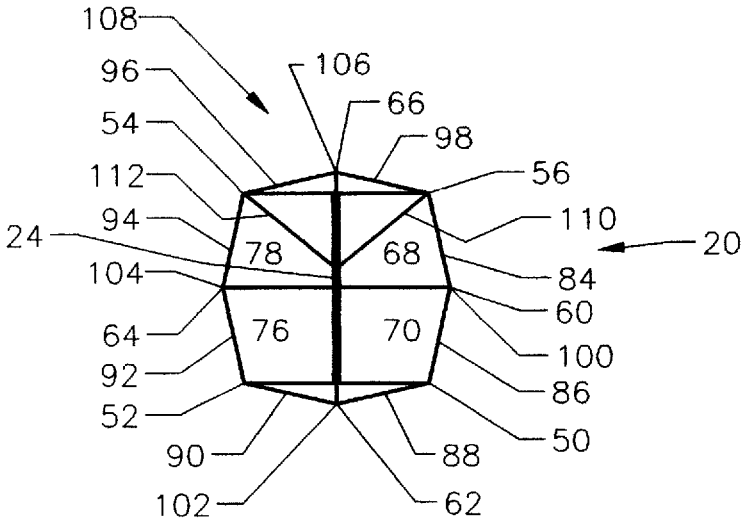

There is illustrated in FIG. 5 a top plan view of the carton of FIG. 1.

Figure 6:
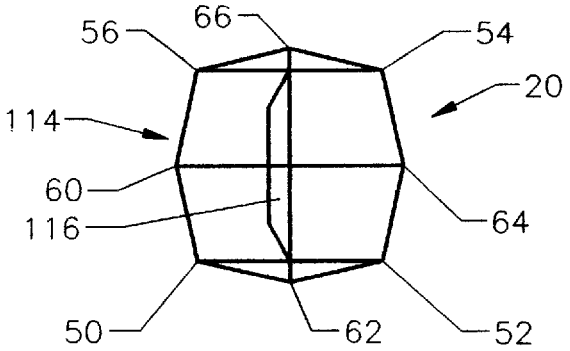

There is illustrated in FIG. 6 a bottom plan view of the carton of FIG. 1.

Figure 7:
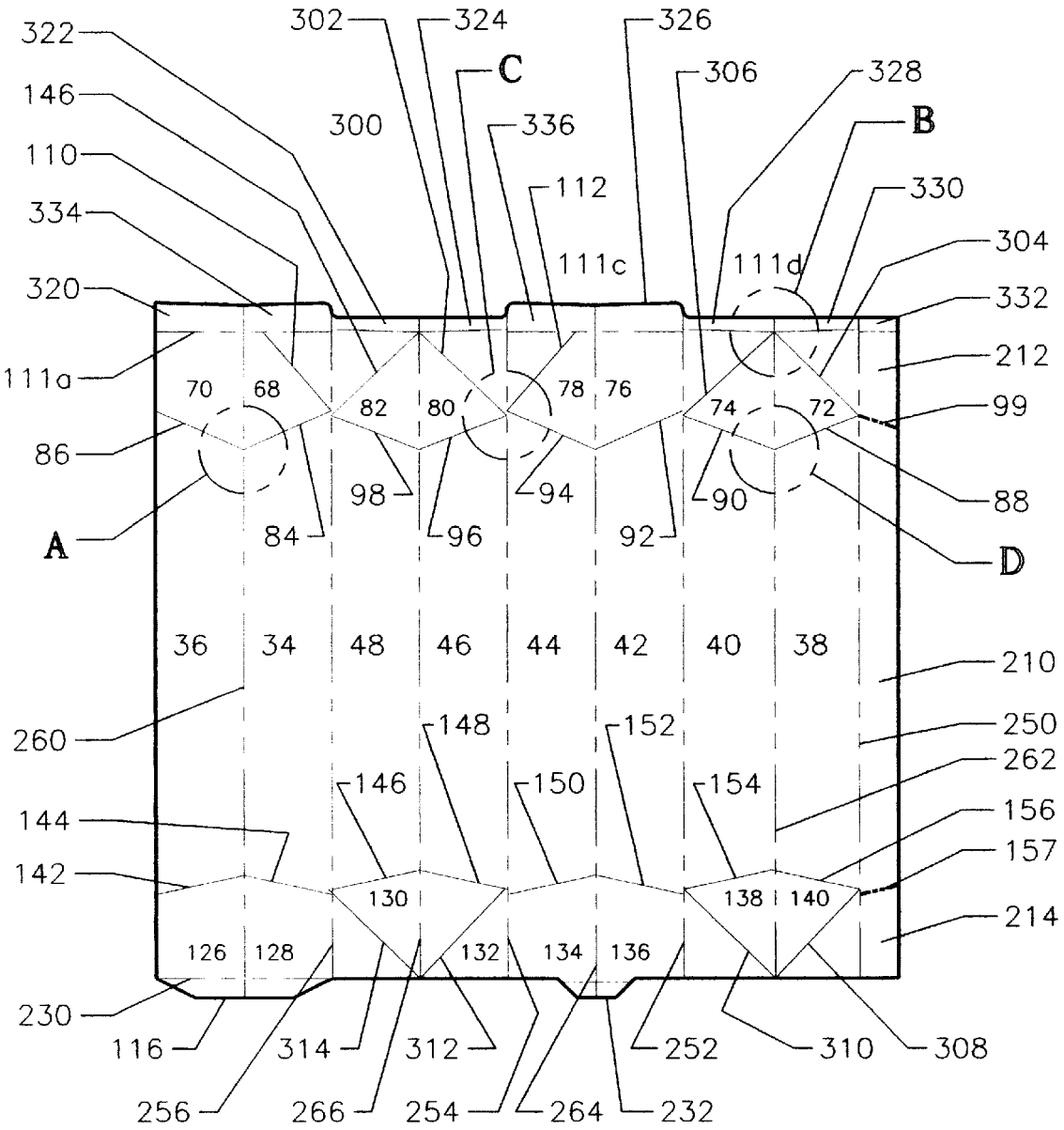
Figure 7A:
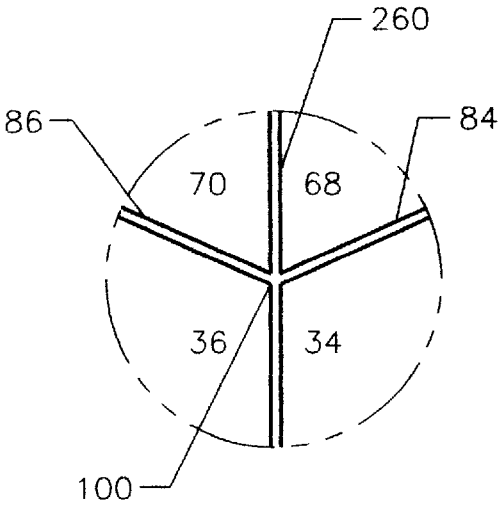
Figure 7B:
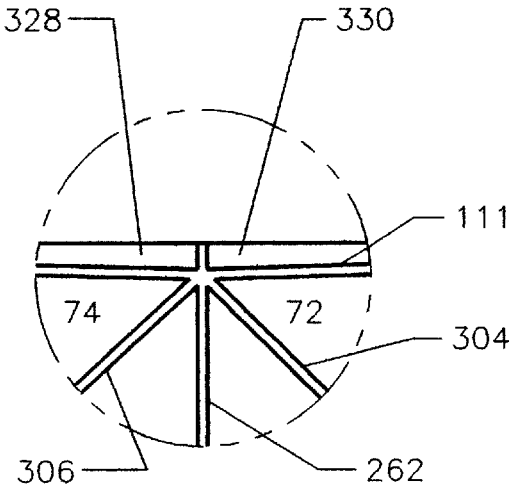
Figure 7C:
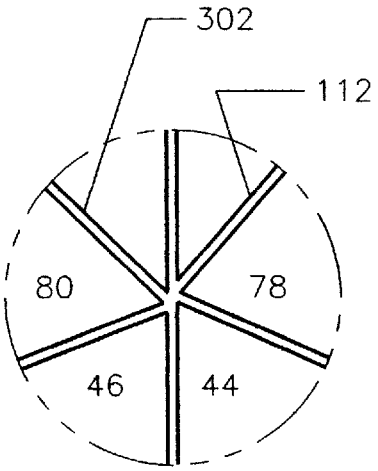
Figure 7D:
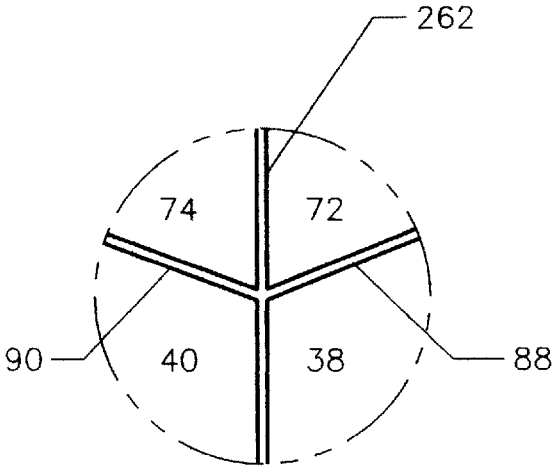

There is illustrated in FIG. 7 a plan view of one embodiment of a carton blank constructed in accordance with the teachings of the present invention.

There is illustrated in FIGS. 7A–7D enlarged views of important score lines of the carton blank of FIG. 7.

DETAILED DESCRIPTION OF THE INVENTION

There is illustrated in FIG. 1 a perspective view of a folded and sealed carton of the present invention. There is illustrated in FIG. 2 a bottom perspective view of the carton of FIG. 1. As shown in FIGS. 1 and 2, the eight-sided carton is generally designated 20. The carton 20 has a gable top structure 22 with the top flaps meeting to form a top fin 24. The carton has four general sides designated first side 26, second side 28, third side 30 and fourth side 32. The four general sides 26–32, are further divided into eight side panels 34–48 thereby forming the eight-sided carton 20.

The four general sides 26–32 are separated from each other by four edges 50–56 which are formed from vertical score lines extending from the top of the carton blank to the bottom as described below in reference to FIG. 7. The side panels 34–48 are separated from each other by the four edges 50–56 and on each individual side 26–32 by a plurality of apices 60–66. The plurality of apices are formed from additional vertical score lines extending from the top of the carton blank to the bottom as described below in reference to FIG. 7. Each apex of the plurality of apices 60–66 extends outward from a central vertical axis of the carton 20 thereby forming the most distant line/point from the central vertical axis of the carton 20 on each of the general sides 26–32. For example, apex 60 is the most distant line/point from the central vertical axis of the carton 20 on side 26, and separates side panel 34 from side panel 36. The extension of apex 60 is best seen in FIG. 4 which is a side elevational view of FIG. 1. The extension of all the apices 60–66 is also shown in FIGS. 5 and 6 which are respectively a top plan view and a bottom plan view of the carton of FIG. 1. Not only do the apices 60–66 provide an unique shape to the carton 20, the apices 60–66 allow for a greater volume per surface area of the carton 20 as compared to a traditional flat four-sided carton. Thus, the carton 20 will provide the consumer with the same volume of product as a traditional carton while using less material. The carton 20 also is more grippable than typical cartons.

Returning to FIG. 1, the gable top structure 22 is formed from a plurality of top flaps 68–82 with flaps 80 and 82 not shown in FIGS. 1–6. Flaps 72, 74, 80 and 82 are folded inward while flaps 68,70, 76 and 78 are folded on top of flaps 72, 74, 80 and 82 to form the gable top structure 22. The plurality of top flaps 68–82 are separated from each other by the plurality of vertical score lines which form the plurality of edges 50–56 and the plurality of apices 60–66. The plurality of top flaps 68–82 are separated from the plurality of side panels 34–48 by a plurality of top diagonal score lines 84–98. The plurality of top diagonal score lines 84–98 allow for the plurality of top flaps 68–82 to intersect with the corresponding plurality of apices 60–66 at a plurality of intersection points 100–106. Each pair of the plurality of top diagonal score lines 84–98 forms a V-shaped intersection between the corresponding plurality of top flaps 68–82 and plurality of side panels 34–48. This allows for a more graceful transition from the top flaps to the side panels.

To access the contents of the carton 20, an integrated pour spout 108 is provided to the consumer. The pour spout 108 is readied by tearing open the carton 20 at the top flaps 68, 78, 80 and 82. Upper score lines 110 and 112 define the portion of top flaps 68 and 78 which form part of the pour spout 108. Intersection point 106 suffices as the bottom of the pour spout 108. In opening the pour spout 108, the top fin 24 is split in two by the consumer. It is further contemplated that a fitment, not shown, may be attached to the carton 20 for accessing the product.

Top fin 24 defines a central plane of the carton 20 extending from the top to the bottom of the carton 20 with the top fin 24 lying on the central plane. The top fin 24 is separated from the plurality of top flaps 68–82 by a top horizontal score line 111. In a preferred embodiment, apices 62 and 66 are parallel to the top fin 24 and lie on the central plane while a plane intersecting both apices 60 and 64 is perpendicular to the top fin 24 and thus is perpendicular to the central plane of the carton 20. In one embodiment of the carton 20 of the present invention, the carton 20 has an octagonal cross–section. In such an embodiment, if apex 66 is at zero degrees, then each of the other apices and edges would have the following rotational coordinates: edge 56, forty–five degrees; apex 60, ninety degrees; edge 50, one hundred thirty-five degrees; apex 62, one hundred eighty degrees; edge 52, two hundred twenty-five degrees; apex 64, two hundred seventy degrees; and edge 54, three hundred fifteen degrees. Such rotational coordinates are best illustrated in FIGS. 5 and 6. The top fin 24 may also have a curved top surface for interlocking as illustrated in copending U.S. Pat. application Ser. No. 08/766,493 filed on Dec. 13, 1996 for a Stackable Gable Top Carton And Corresponding Top Interlocking Carton Blank which is hereby incorporated by reference.

The novel and inventive carton 20 of the present invention also has a novel and inventive inverse pyramidal bottom 114 which is best illustrated in FIGS. 2–4. The inverse pyramidal bottom 114 maintains the bottom fin 116 elevated from a surface that the carton 20 may stand on during filling, distribution or in use by the consumer. By elevating the bottom fin 116, damage to the bottom fin 116 may be lessened thereby decreasing the opportunity for leakage of the carton 20. In a preferred embodiment, only the bottom edges 118–124 will come in contact with any surface when the carton is standing upright. The inverse pyramidal bottom 114 also provides better stability to the carton 20 than traditional four-sided cartons which tend to wobble due to bulging at the bottom. It is further contemplated that the bottom edges 118–124 would have a flatter surface for increased contact with a surface.

The inverse pyramidal bottom 114 is formed from a plurality of bottom flaps 126–140. Flaps 130, 132, 138 and 140 are folded inward first while flaps 126,128, 134 and 136 are folded on top thereof to form the inverse pyramidal bottom 114. The plurality of bottom flaps 126–140 are separated from each other by the plurality of vertical score lines which form the plurality of edges 50–56 and the plurality of apices 60–66. The plurality of bottom flaps 126–140 are separated from the plurality of side panels 34–48 by a plurality of bottom diagonal score lines 142–156. The plurality of bottom diagonal score lines 142–156 allow for the plurality of bottom flaps 126–140 to intersect with the corresponding plurality of apices 60–66 at a plurality of intersection points 158–164. Each pair of the plurality of bottom diagonal score lines 142–156 forms an inverse V-shaped intersection between the corresponding plurality of bottom flaps 126–140 and plurality of side panels 34–48. This allows for a more graceful transition from the bottom flaps to the side panels, and provides for the better stability of the carton 20. The bottom fin 116 is folded and sealed to panels 134 and 136.

There is illustrated in FIG. 7 a plan view of one embodiment of a carton blank constructed in accordance with the teachings of the present invention. The carton blank 200 is fabricated into the carton 20 illustrated in FIG. 1. The blank 200 may be formed, filled and sealed on a packaging machine such as available from TETRA PAK, INCORPORATED of Chicago, Ill. The circles A-D are illustrated in FIGS. 7A–7D, and are enlarged views of the intersection of some of the score lines. The blank 200 is defined by a plurality of score lines which allow the blank 200 to be folded into the eight-sided carton 20 as illustrated in FIG. 1. A plurality of edge vertical score lines 250–256 will form edges 50–56 of the carton 20. A plurality of apex vertical score lines 260–266 will form apices 60–66. The plurality of edge vertical score lines 250–256 and the plurality of apex vertical score lines 260–266 will define the side panels 34–48 of the carton 20. The edge vertical score line 250 separates side panel 38 from a sealing panel 210. The sealing panel 210 is folded under side panel 36 during the initial forming of the carton 20.

The plurality of top diagonal score lines 84–98 defines the plurality of top flaps 68–82 from the plurality of side panels 34–48. A top diagonal score line 99 defines a top sealing flap 212 from the sealing panel 210. The plurality of bottom diagonal score lines 142–156 defines the plurality of bottom flaps 126–140 from the plurality of side panels 34–48. A bottom diagonal score line 157 defines a bottom sealing flap 214 from the sealing panel 210. A bottom horizontal score line 230 defines the bottom fin 116. A second bottom fin 232 is folded under and sealed to fin 116.

Upper diagonal score lines 300 and 302 define the pour spout 108 along with upper diagonal score lines 110 and 112. Upper diagonal score lines 304 and 306 assist in folding top flaps 72 and 74 inward to create the gable top structure 22 of the carton 20. A plurality of lower diagonal score lines 308–314 assist in creating the inverse pyramidal bottom 114 of the carton 20. The top fin 24, as shown in FIG. 1, may be divided into a plurality of fin flaps 320–336 by the corresponding plurality of vertical score lines.

It will be appreciated by those skilled in the pertinent art that various multi–sided cartons other than eight-sided cartons may be fabricated using the teachings of the present invention. By increasing the number of apex vertical score lines and the corresponding diagonal score lines, cartons having a greater number than eight side panels is possible. Thus, each increase in the number of apices on one general side will increase the number of panels by four for the total carton. For example, if each side has two apices, then each side will have three side panels for a twelve-sided carton. If each side has three apices, then each side will have four side panels for a sixteen-sided carton.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. A gable top carton comprising:

a gabled top structure having a fin defining a central plane; and first, second, third, fourth, fifth, sixth, seventh and eighth side panels engaging the gabled top structure to form an eight-sided body, the first and second side panels meeting to form a first apex lying on the central plane, the third and fourth side panels meeting to form a second apex, the second apex lying on a vertical plane perpendicular to the central plane, the fifth and sixth side panels meeting to form a third apex lying on the central plane opposite the first apex, the seventh and eighth side panels meeting to form a fourth apex, the fourth apex lying on the vertical plane perpendicular to the central plane and opposite of the second apex;

whereby the first apex, the second apex, the third apex and the fourth apex extend the greatest distance outward from a central vertical axis of the carton.

2. The gable top carton according to claim 1 further comprising an inverse pyramidal bottom.

3. The gable top carton according to claim 1 wherein the gabled top structure comprises a first and second top panels on opposite sides of the top fin, the first top panel engaging the third and fourth side panels to form a V-shaped intersection with the center of the V located at the second apex, the second top panel engaging the seventh and eighth side panels to form a V-shaped intersection with the center of the V located at the fourth apex.

4. The gable top carton according to claim 1 further comprising an octagonal cross-section.

5. The gable top carton according to claim 1 further comprising a third and fourth top panels on opposite sides of the top fin, the third top panel engaging the first and second side panels to form a V-shaped intersection with the center of the V located at the first apex, the fourth top panel engaging the fifth and sixth side panels to form a V-shaped intersection with the center of the V located at the third apex.

6. A gable top carton comprising:

a top gabled structure having a top fin defining a central plane;

first, second, third, and fourth sides, the first side opposite the third side, the second side opposite the fourth side, the first and third sides substantially perpendicular to the central plane and the second and fourth sides substantially parallel to the central plane, each of the first, second, third, and fourth sides having a plurality of side panels engaging the gabled top structure to form a multi-sided body, each of the plurality of side panels meeting each other within one of the sides at one of a plurality of apices.

7. The gable top carton according to claim 6 wherein the number of apices is half of the number of side panels.

8. The gable top carton according to claim 6 wherein the number of apices of one side is equal to x minus 1 where x is the number of side panels on the one side.

9. The gable top carton according to claim 6 further comprising an inverse pyramidal bottom.

10. The gable top carton according to claim 6 further comprising an octagonal cross-section.

11. A blank for fabrication into an eight-sided gable top carton, the blank comprising:

first, second, third and fourth quarter panels and a sealing panel, the quarter panels and the sealing panel separated from each other by a plurality of edge vertical score lines, each of the quarter panels divided into a pair of side panels by a plurality of apex vertical score lines; and first, second, third and fourth bottom flaps and a bottom sealing flap respectively adjacent the first, second, third and fourth quarter panels and the sealing panel, the bottom flaps separated from each other by the plurality of edge vertical score lines, each of the bottom flaps further divided by the plurality of apex vertical score lines, the bottom flaps respectively separated from the quarter panels by a plurality of bottom diagonal score lines.

12. The blank according to claim 11 further comprising:

first, second, third and fourth top flaps and a top sealing flap respectively adjacent the first, second, third and fourth quarter panels and the sealing panel, the top flaps separated from each other the plurality of edge vertical score lines, each of the top flaps further divided by the plurality of apex vertical score lines, the top flaps respectively separated from the quarter panels by a plurality of top diagonal score lines.

13. The blank according to claim 12 further comprising first, second, third and fourth top fin flaps and a top sealing fin flap respectively adjacent the first, second, third and fourth top flaps and the top sealing flap, the top fin flaps and the top sealing fin flap respectively separated from the top flaps and the top sealing flap by a plurality of top horizontal score lines, the top fin flaps and the top sealing flap separated from each other by the plurality of edge vertical score lines, the top fin flaps divided by the plurality of apex vertical score lines.

14. The blank according to claim 12 further comprising the second and fourth top flaps divided by a plurality upper diagonal score lines, each of the upper diagonal score lines extending from an intersection of one of the top diagonal score lines and one of the edge vertical score lines and an intersection of one of the plurality of top horizontal score lines and one of the apex vertical score lines.

15. The blank according to claim 11 further comprising first and second bottom fin flaps respectively adjacent the first and third bottom flaps, the bottom fin flaps respectively separated from the bottom flaps by a plurality of bottom horizontal score lines, the bottom fin flaps divided by the plurality of apex vertical score lines.

16. The blank according to claim 15 further comprising the second and fourth bottom flaps divided by a plurality lower diagonal score lines, each of the lower diagonal score lines extending from an intersection of one of the bottom diagonal score lines and one of the edge vertical score lines and an intersection of one of the bottom horizontal score lines and one of the apex vertical score lines.

17. A blank for fabrication into an eight-sided gable top carton, the blank comprising:

first, second, third, fourth, fifth, sixth, seventh and eighth side panels and a sealing panel, the side panels and the sealing panel separated from each other by a plurality of vertical score lines;

first, second, third, fourth, fifth, sixth, seventh and eighth bottom flaps and a bottom sealing flap respectively adjacent the first, second, third, fourth, fifth, sixth, seventh and eighth side panels and the sealing panel, the bottom flaps separated from each other by the plurality of vertical score lines, the bottom flaps respectively separated from the side panels by a plurality of bottom diagonal score lines.

18. The blank according to claim 17 further comprising:

first, second, third, fourth, fifth, sixth, seventh and eighth top flaps and a top sealing flap respectively adjacent the first, second, third, fourth, fifth, sixth, seventh and eighth side panels and the sealing panel, the top flaps separated from each other by the plurality of vertical score lines, the top flaps respectively separated from the side panels by a plurality of top diagonal score lines.

19. The blank according to claim 18 further comprising first, second, third, fourth, fifth, sixth, seventh and eighth top fin flaps and a top sealing fin flap respectively adjacent the first, second, third, fourth, fifth, sixth, seventh and eighth top flaps and the top sealing flap, the top fin flaps and the top sealing fin flap respectively separated from the top flaps and the top sealing flap by a top horizontal score line, the top fin flaps and the top sealing flap separated from each other by the plurality of vertical score lines.

20. The blank according to claim 18 further comprising the third, fourth, seventh and eighth top flaps divided by a plurality upper diagonal score lines, each of the upper diagonal score lines extending from an intersection of one of the top diagonal score lines and one of the vertical score lines and an intersection of the top horizontal score line and one of the vertical score lines.

21. The blank according to claim 17 further comprising first and second bottom fin flaps respectively adjacent the first and third bottom flaps, the bottom fin flaps respectively separated from the bottom flaps by a plurality of bottom horizontal score lines, the bottom fin flaps divided by the plurality of apex vertical score lines.

22. The blank according to claim 21 further comprising the third, fourth, seventh and eighth bottom flaps divided by a plurality lower diagonal score lines, each of the lower diagonal score lines extending from an intersection of one of the bottom diagonal score lines and one of the vertical score lines and an intersection of one of the bottom horizontal score lines and one of the vertical score lines.

* * * * *

UNITED STATES PATENT AND TRADEMARK OFFICE

CERTIFICATE OF CORRECTION

PATENT NO. : 5,871,144
DATED : February 16, 1999
INVENTOR(S) : Anchor et al.

It is certified that error appears in the above-identified patent and that said Letters Patent is hereby corrected as shown below:

Item [75] Inventors: David Anchor, Union; Russell Stacy-Ryan, Chicago, both of Ill.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*